US011446792B2

(12) United States Patent
Miller et al.

(10) Patent No.: US 11,446,792 B2
(45) Date of Patent: Sep. 20, 2022

(54) RETRIEVAL DEVICE

(71) Applicants: Thomas Miller, Hastings, MI (US); Timothy Miller, Charlotte, MI (US)

(72) Inventors: Thomas Miller, Hastings, MI (US); Timothy Miller, Charlotte, MI (US)

( * ) Notice: Subject to any disclaimer, the term of this patent is extended or adjusted under 35 U.S.C. 154(b) by 131 days.

(21) Appl. No.: 16/899,004

(22) Filed: Jun. 11, 2020

(65) Prior Publication Data

US 2021/0046616 A1 Feb. 18, 2021

Related U.S. Application Data

(60) Provisional application No. 62/886,574, filed on Aug. 14, 2019.

(51) Int. Cl.
*B25B 5/14* (2006.01)
*B25B 5/16* (2006.01)
(Continued)

(52) U.S. Cl.
CPC ..... *B25B 5/14* (2013.01); *A63B 47/02* (2013.01); *B25B 5/16* (2013.01); *F41B 5/1465* (2013.01)

(58) Field of Classification Search
CPC . F41B 5/1465; B25B 3/00; B25B 5/12; B25B 5/125; B25B 5/14; B25B 5/16; B25B 5/06; B25B 5/163; B25B 7/12; B25B 9/00; B25B 31/00; B25C 11/00; Y10T 29/53796; Y10T 29/53896; Y10T 29/539;
(Continued)

(56) References Cited

U.S. PATENT DOCUMENTS 1,122,898 A * 12/1914 Fuller ..... F16G 11/12 254/242
1,591,525 A * 7/1926 Gardner ..... B21C 1/14 24/132 R
(Continued)

FOREIGN PATENT DOCUMENTS

EP 0424307 A2 * 4/1991 ..... F16G 11/106
WO WO-2007057022 A1 * 5/2007 ..... B25B 9/00

OTHER PUBLICATIONS

Website available at least as early as Aug. 1, 2019 at: https://bowfishingextreme.com/product/arrow-saver-hd-puller-aluminum/.

*Primary Examiner* — Monica S Carter
*Assistant Examiner* — Alberto Saenz
(74) *Attorney, Agent, or Firm* — Patentfile, LLC; Bradley C. Fach; Steven R. Kick

(57) ABSTRACT

A retrieval device may include a first plate and a second plate which may be movably coupled to a body via a first body fastener and a second body fastener, respectively. An upper plate connector and a lower plate connector may each be movably coupled to the first plate and a second plate with the lower plate connector positioned between the upper plate connector and the body fasteners. An optional tensioner may tension portions of the first plate and a second plate together. Upper gripper(s) may be coupled to the upper plate connector and lower gripper(s) may be coupled to the lower plate connector. The device may be movable between an open position, in which the upper gripper(s) and lower gripper(s) are positioned relatively distally from each other, and a closed position, in which the upper gripper(s) and lower gripper(s) are positioned relatively proximate to each other.

15 Claims, 8 Drawing Sheets

(51) Int. Cl.
*F41B 5/14* (2006.01)
*A63B 47/02* (2006.01)

(58) Field of Classification Search
CPC ..... Y10T 29/53909; Y10T 29/53943; Y10T 24/394; Y10T 24/3949; B66F 15/00; F16G 11/101; B66D 3/02
USPC ..... 269/45, 228, 156; 29/244, 255, 278; 254/254, 255; 74/502.4, 502.5, 502.6; 140/123.5; 24/132 AA, 115 R; 294/217, 294/101, 104, 116, 901
See application file for complete search history.

(56) References Cited

U.S. PATENT DOCUMENTS 3,886,631 A * 6/1975 Caradot ..... B66D 3/02 24/134 N
3,995,830 A * 12/1976 Desplats ..... B66D 3/02 254/384
4,483,517 A * 11/1984 Cavalieri ..... B25B 25/00 226/112
2003/0074776 A1* 4/2003 Miles ..... F41B 5/1465 29/426.5
2019/0084164 A1* 3/2019 Mounsdon ..... F41B 5/1465

* cited by examiner

RETRIEVAL DEVICE

CROSS REFERENCE TO RELATED APPLICATIONS

This application claims priority to and the benefit of the filing date of U.S. Provisional Application No. 62/886,574, filed on Aug. 14, 2019, entitled "Retrieval Device", which is hereby incorporated by reference in its entirety.

FIELD OF THE INVENTION

This patent specification relates to the field of devices for retrieving and removably coupling objects. More specifically, this patent specification relates to a device configured to retrieve objects and to mechanically convert retrieving force on the device into gripping force onto the objects.

BACKGROUND

Many people find it beneficial to use devices which facilitate the retrieval of objects. For example, people use devices configured to pick up and retrieve objects, such as tennis balls, pecans, and litter. However, some objects may be more difficult to pick up or retrieve due to their weight or being embedded in the environment. This is especially true for users of bows and crossbows whose arrows and bolts tend to become lodged or stuck in the ground and vegetation. Furthermore, people participating in bowfishing face the additional challenge of all or part of their arrows and bolts being submerged in water and mud which can make the retrieval of the arrows and bolts particularly challenging.

Therefore, a need exists for novel devices for retrieving and removably coupling objects. There is also a need for novel devices which are able to facilitate the retrieval of objects, such as bolts and arrows, which may be stuck, submerged or otherwise difficult to retrieve. A further need exists for novel retrieval devices which are configured to provide a mechanical advantage to the user to assist in the retrieval and pickup of objects.

BRIEF SUMMARY OF THE INVENTION

A retrieval device is provided which may be configured to provide mechanical advantage for the retrieval and pickup of objects. In some embodiments, the device may include a first plate and a second plate which may be movably coupled to a body via a first body fastener and a second body fastener, respectively. An upper assembly, which includes an upper plate connector, one or more upper fasteners, and one or more upper grippers, and a lower assembly, which includes a lower plate connector, one or more lower fasteners, and one or more lower grippers, may be movably coupled together so that they are movable between an open position and a closed position. The upper plate connector and the lower plate connector may each be movably coupled to the first plate and a second plate with the lower plate connector positioned between the upper plate connector and the body fasteners. An optional tensioner may tension portions of the first plate and a second plate together. Preferably, a first upper gripper may be coupled to the upper plate connector and a first lower gripper may be coupled to the lower plate connector. The device may be movable between an open position, in which the first upper gripper and first lower gripper are positioned relatively distally from each other, and a closed position, in which the first upper gripper and first lower gripper are positioned relatively proximate to each other. While the device is in the open position, a portion of an object, such as the shaft of an arrow or bolt, may be positioned between the upper assembly and the lower assembly. The device may then be moved into or towards the closed position, thereby clamping the object between the grippers of each assembly. Pulling on the device increases the clamping force to facilitate pulling or retrieving the object from the material that it may be embedded in. Increasing the pulling force on the body may result in increasing the clamping force of the grippers on the object. Conversely, decreasing the pulling force on the body may result in decreasing the clamping force of the grippers on the object.

In further embodiments, the device may be movable between an open position, in which the upper assembly may comprise the first upper fastener, second upper fastener, upper plate connecter, and upper gripper(s) are positioned relatively distally from the lower assembly consisting of the first lower fastener, second lower fastener, lower plate connector, and lower gripper(s), and a closed position, in which the upper assembly consisting of the first upper fastener, second upper fastener, upper plate connecter, and upper gripper(s) and are positioned relatively proximate to the lower assembly consisting of the first lower fastener, second lower fastener, lower plate connector, and lower gripper(s).

In still further embodiments, a retrieval device may include a first plate that may be movably coupled to a body via a first body fastener. A second plate may be movably coupled to the body via a second body fastener. An upper plate connector may be movably coupled to the first plate and to the second plate. A lower plate connector may be movably coupled to the first plate and to the second plate. The lower plate connector may be coupled to the first plate between the upper plate connector and the first body fastener, and the lower plate connector may be coupled to the second plate between the upper plate connector and the second body fastener. One or more upper grippers, such as a first upper gripper, may be coupled to the upper plate connector. One or more lower grippers, such as a first lower gripper, may be coupled to the lower plate connector. The device may be movable between an open position, in which the upper gripper(s) and lower gripper(s) are positioned relatively distally from each other, and a closed position, in which the upper gripper(s) and lower gripper(s) are positioned relatively proximate to each other.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Figure 1:
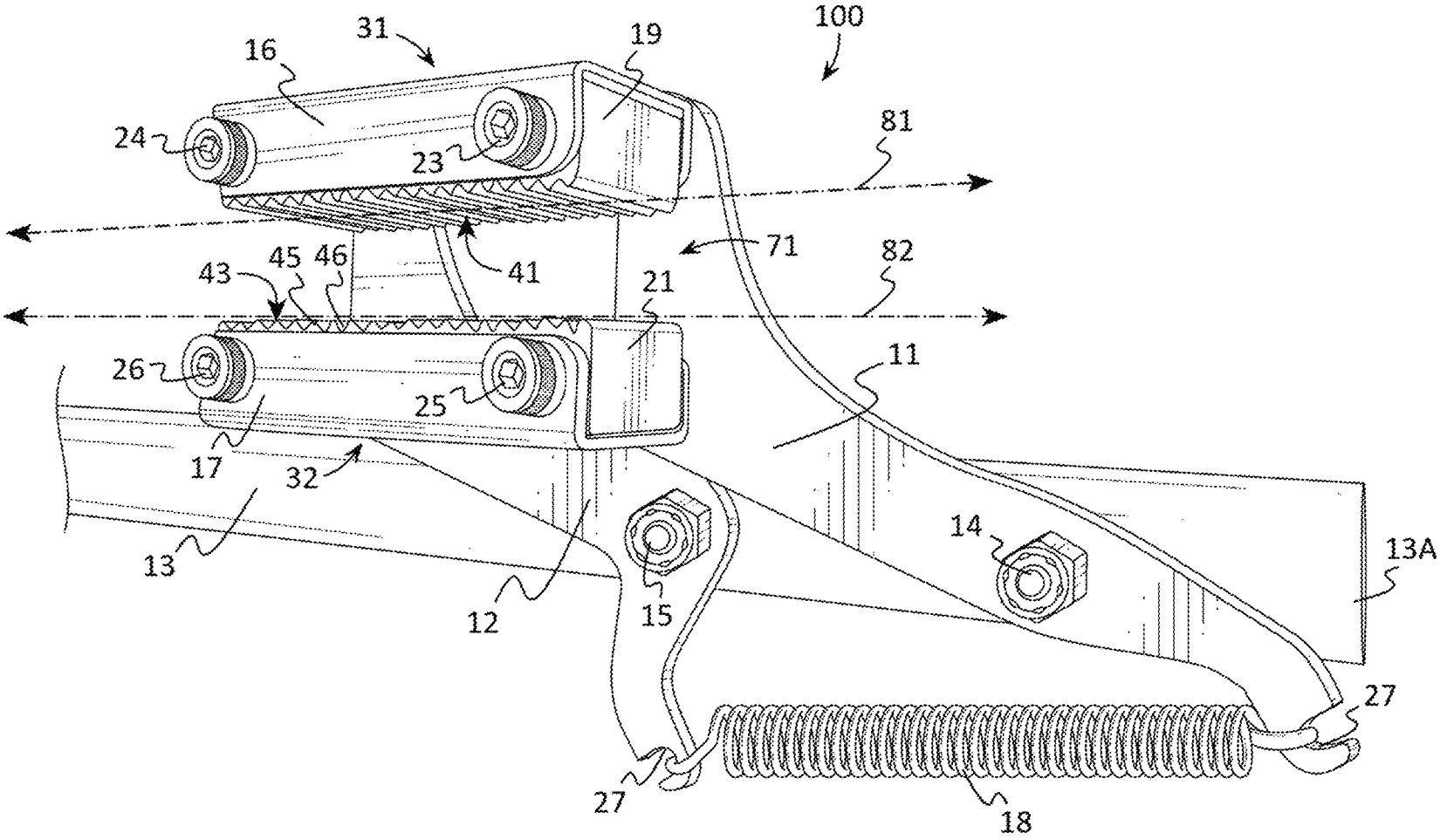
FIG. 1-FIG. 1 depicts a front perspective view of an example of a retrieval device in an open position according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts of the invention. Hence, specific dimensions and other physical characteristics relating to the embodiments disclosed herein are not to be considered as limiting, unless expressly stated otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

A new object retrieval device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-8 illustrate examples of a retrieval device ("the device") 100 according to various embodiments. In some embodiments, the device 100 may comprise a first plate 11 and a second plate 12 which may be movably coupled to a body 13 via a first body fastener 14 and a second body fastener 15, respectively. An upper assembly 31, which may include an upper plate connector 16, one or more upper fasteners 23, 24, and one or more upper grippers 19, 20, and a lower assembly 32, which may include a lower plate connector 17, one or more lower fasteners 25, 26, and one or more lower grippers 21, 22, may be movably coupled together so that they are movable between an open position 71 and a closed position 72. The upper plate connector 16 and lower plate connector 17 may each be movably coupled to the first plate 11 and a second plate 12 with the lower plate connector 17 positioned between the upper plate connector 16 and the body fasteners 14, 15. A tensioner 18 may tension portions of the first plate 11 and a second plate 12 together. A first upper gripper 19 may be coupled to the upper plate connector 16, and a first lower gripper 21 may be coupled to the lower plate connector 17. The device 100 may be movable between an open position 71 (FIGS. 1, 2, 4, and 7), in which at least one upper gripper 19, 20, of the upper assembly 31 may be positioned relatively distally from at least one lower gripper 21, 22, of the lower assembly 31, and a closed position 72 (FIGS. 3, 5, and 8), in which at least one upper gripper 19, 20, of the upper assembly 31 may be positioned relatively proximate to at least one lower gripper 21, 22, of the lower assembly 31. While the device 100 is in the open position 71, a portion of an object 200, such as the shaft of an arrow or bolt, may be positioned between the assemblies 31, 32. The device 100 may then be moved into or towards the closed position 72, thereby clamping the object 200 between the grippers 19, 20, 21, 22, of the assemblies 31, 32. Pulling on the device 100 increases the clamping force exerted by the grippers 19, 20, 21, 22, to facilitate pulling or retrieving the object 200 from the material that it may be embedded in.

The device 100 may comprise a body 13 to which the plates 11, 12, may be movably coupled. A body 13 may be configured in any size and shape. In preferred embodiments, a body 13 may comprise an elongated shape, such as an elongated cylindrical shape, of any desired length. In further embodiments, a body 13 may comprise an elongated rectangular prism shape, an elongated triangular prism shape, an elongated hexagonal prism shape, or any other shape, including combinations of shapes. A body 13 may comprise a working end 13, to which the plates 11, 12, and assemblies 31, 32, may be coupled to, and a holding end 13B, which may comprise portions of the body 13 that may be configured as or function as a handle which the user may use to manipulate the device 100 and to position an object 200 between the upper grippers 19, 20, and lower grippers 21, 22. A body 13 may be made from any suitable substantial rigid material, such as metal and metal alloys, including 1.0 inch outer diameter by 0.065 inch wall aluminum tube, wood and other natural materials, hard plastics, such as PVC, fiberglass, carbon fiber, etc. Optionally, a body 13 may comprise or be coupled to a grip enhancing material, such as rubber, silicone, soft plastics, and the like, which may be molded or shaped to conform to the grip of a user.

The device 100 may comprise a first plate 11 and a second plate 12 which may be movably coupled to a body 13 at or proximate to the working end 13A. The plates 11, 12, may comprise any shape and size. Preferably, the plates 11, 12, may comprise a generally elongated shape which may allow the body fastener 14, 15, that movably couples the plate 11, 12, to the body 13 to be positioned between the portion of the plate 11, 12, that may be coupled to a tensioner 18 and the portions of the plate 11, 12, that may be coupled to the upper 31 and lower 32 assemblies.

In preferred embodiments, the plates 11, 12, may be made from ⅛-inch stainless steel plate material, while in other embodiments, the plates 11, 12, may be made from or may comprise any suitable substantial rigid material.

A first plate 11 may be movably coupled to the body 13 with a first body fastener 14, and a second plate 12 may be movably coupled to the body 13 with a second body fastener 15. Preferably, the body fasteners 14, 15, may enable their respective plate 11, 12, to pivot relative to the body 13 so that portions of the plates 11, 12, may be moved towards and away from the working end 13A.

In some embodiments, a body fastener 14, 15, may comprise one or more threaded male body fasteners 14A, 15A, such as a bolt, screw, and/or threaded female body fasteners 14B, 15B, such as a nut, etc. In preferred embodiments, a male body fastener 14A, 15A, may comprise a stainless-steel shoulder bolt or socket head cap screw having a 5⁄16-inch body by 1.25-inch length and ¼-20 threads. In further embodiments, a female body fastener 14B, 15B, may comprise a ¼-20 stainless steel locknut, optionally with nylon insert, or the like which may be mated with a threaded portion of a male body fastener 14A, 15A. In other embodiments, a body fastener 14, 15, may comprise a rivet, ball bearing assembly, a portion of a plate 11, 12, extending through the body 13 functioning as a bearing, a portion of the body 13 extending through a plate 11, 12, functioning as a bearing, a hinge or other pivotal coupling, or any other fastener or coupling method which may enable a plate 11, 12, to pivot relative to the body 13 so that portions of the plate 11, 12, may be moved towards and away from the working end 13A.

The device 100 may comprise one or more plate connectors 16, 17, which may be configured to movably couple the plates 11, 12, together so that movement of one plate 11, 12, results in movement of the other plate 11, 12. In preferred embodiments, the device 100 may comprise an upper plate connector 16 and a lower plate connector 17 which may each be movably coupled to the first plate 11 and a second plate 12 with the lower plate connector 17 positioned between the upper plate connector 16 and the body fasteners 14, 15. In preferred embodiments, plate connectors 16, 17, may be made from ⅛-inch stainless steel plate material, while in other embodiments, plate connectors 16, 17, may be made from or may comprise any suitable substantial rigid material.

A plate connector 16, 17, may be configured in any shape and size. For example, a plate connector 16, 17, may comprise a generally elongated U-shape which may be configured to surround portions of a gripper 19, 20, 21, 22, as perhaps best shown in FIGS. 1 and 2. As another example, a plate connector 16, 17, may comprise a generally elongated flat or planar shape as perhaps best shown in FIG. 6. Generally, a plate connector 16, 17, may comprise any shape and size which may enable the plate connector 16, 17, to extend between and be movably coupled to the first 11 and second 12 plates.

In some embodiments, the device 100 may comprise two plate connectors 16, 17, which may be coupled to the plates 11, 12, so that all or portions of the plate connectors 16, 17, may be approximately parallel to each other. In further embodiments, the device 100 may comprise a plate connector 16, 17, which may be coupled to the plates 11, 12, so that all or portions of the plate connector 16, 17, may be approximately parallel to the body 13. In other embodiments, plate connectors 16, 17, may be coupled in any orientation relative to each other and to the body 13.

Plate connectors 16, 17, may be movably coupled to the plates 11, 12, with one or more fasteners 23, 24, 25, 26. Preferably, an upper plate connector 16 may be coupled to the first plate 11 with a first upper fastener 23 and also coupled to the second plate 12 with a second upper fastener 24. Likewise, a lower plate connector 17 may be coupled to the first plate 11 with a first lower fastener 25 and also coupled to the second plate 12 with a second lower fastener 26. The fasteners 23, 24, 25, 26, may couple their respective plate connector 16, 17, to a plate 11, 12, while enabling their respective plate connector 16, 17, to pivot or move relative to the plates 11, 12.

In some embodiments, a fastener 23, 24, 25, 26, may comprise a male threaded fastener 23A, 24A, 25A, 26A, such as a bolt or screw. In preferred embodiments, a fastener 23, 24, 25, 26, may comprise a stainless-steel shoulder bolt or socket head cap screw having a 5⁄16-inch body by 1.25-inch length and ¼-20 threads. In further embodiments, a fastener 23, 24, 25, 26, may comprise a female fastener 23B, 24B, 25B, 26B, such as a ¼-20 stainless steel locknut, optionally with nylon insert, or the like which may be mated with a male threaded fastener 23A, 24A, 25A, 26A. In other embodiments, a fastener 23, 24, 25, 26, may comprise a rivet, a ball bearing assembly, a portion of a plate connector 16, 17, extending through a plate 11, 12, functioning as a bearing, a portion of a plate 11, 12, extending through a plate connector 16, 17, functioning as a bearing, a hinge or other pivotal coupling, or any other fastener or coupling method which may enable a plate 11, 12, to pivot relative to a plate connector 16, 17, so that portions of the a plate connectors 16, 17, may be moved towards and away from the working end 13A.

Figure 3:
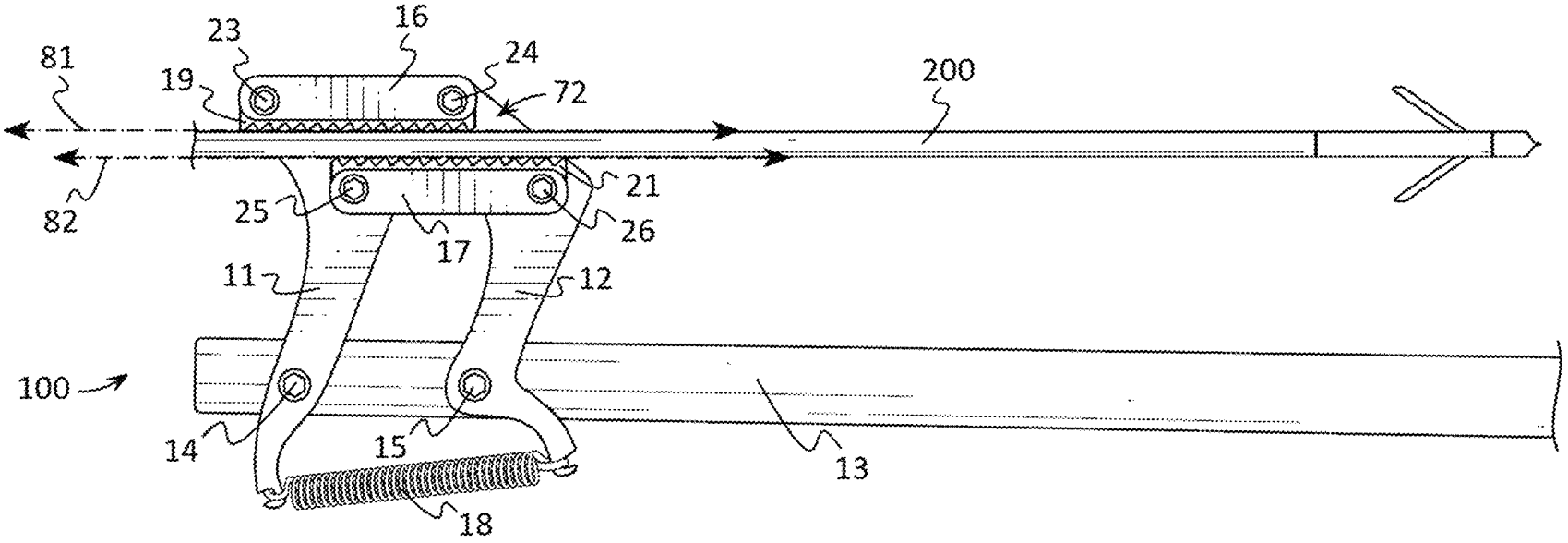
FIG. 3-FIG. 3 shows an elevation view of an example of a retrieval device engaging an object according to various embodiments described herein.
Figure 4:
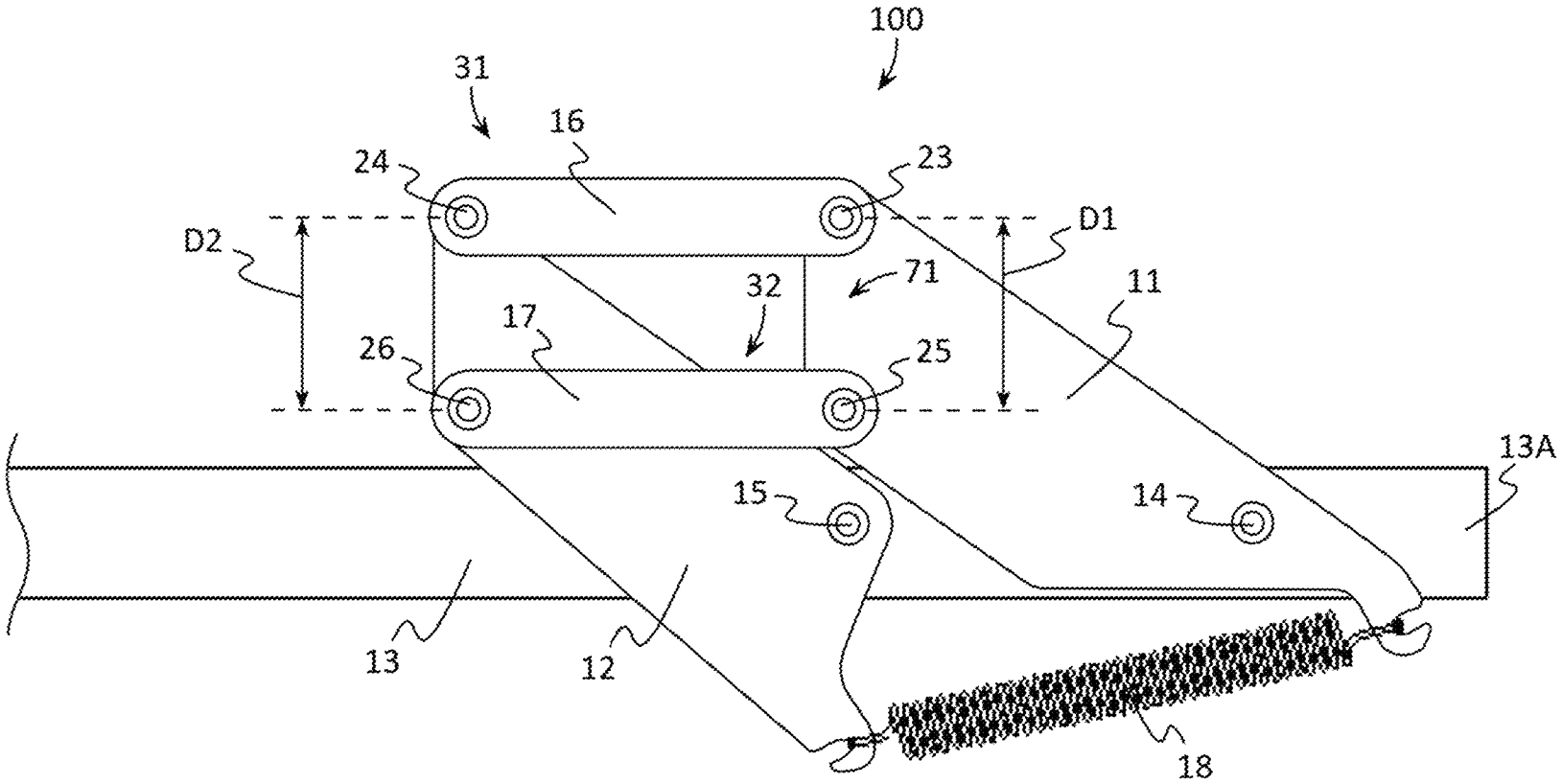
FIG. 4-FIG. 4 depicts an elevation view of another example of a retrieval device in an open position according to various embodiments described herein.
Figure 5:
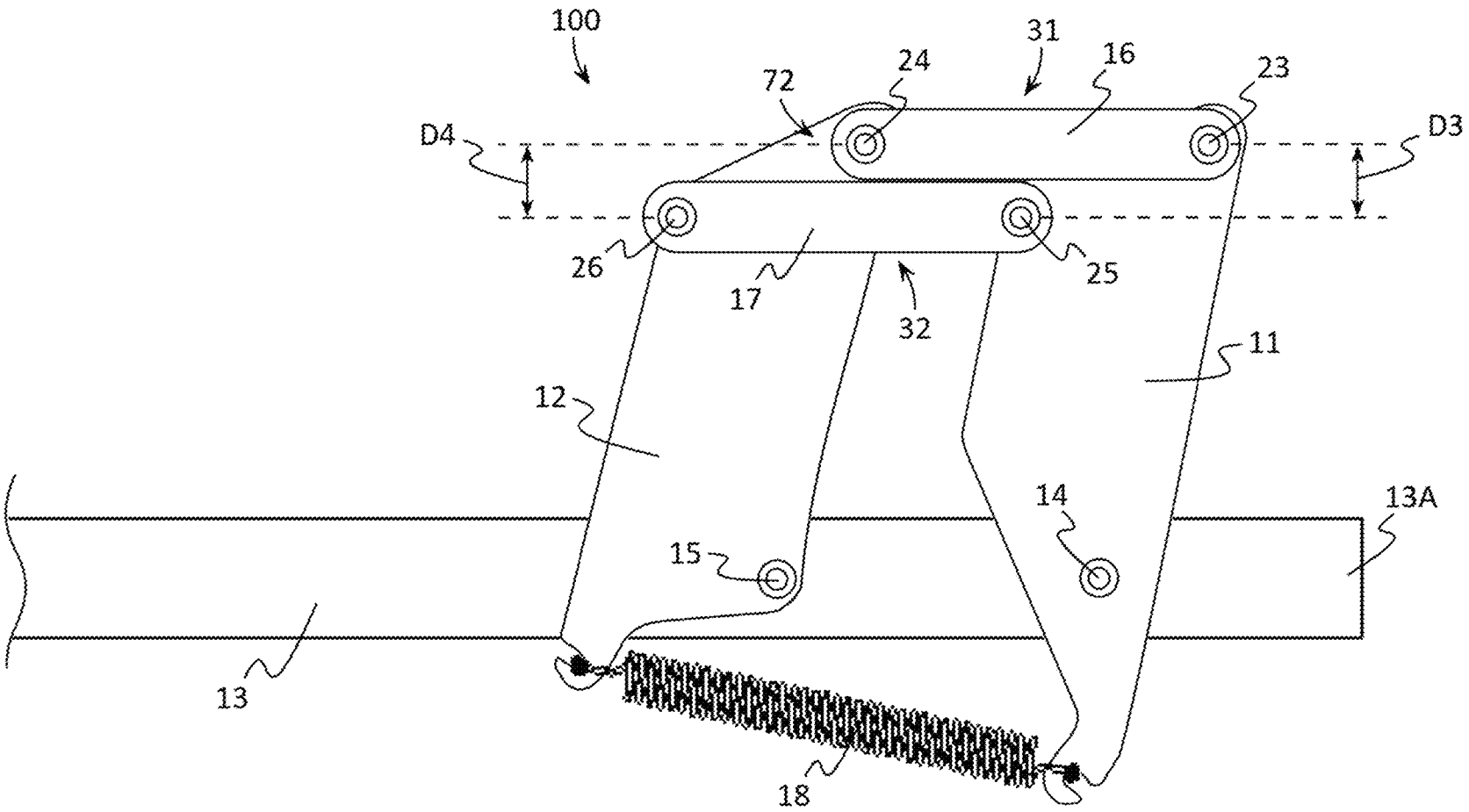
FIG. 5-FIG. 5 illustrates an elevation view of another example of a retrieval device in a closed position according to various embodiments described herein.
Figure 6:
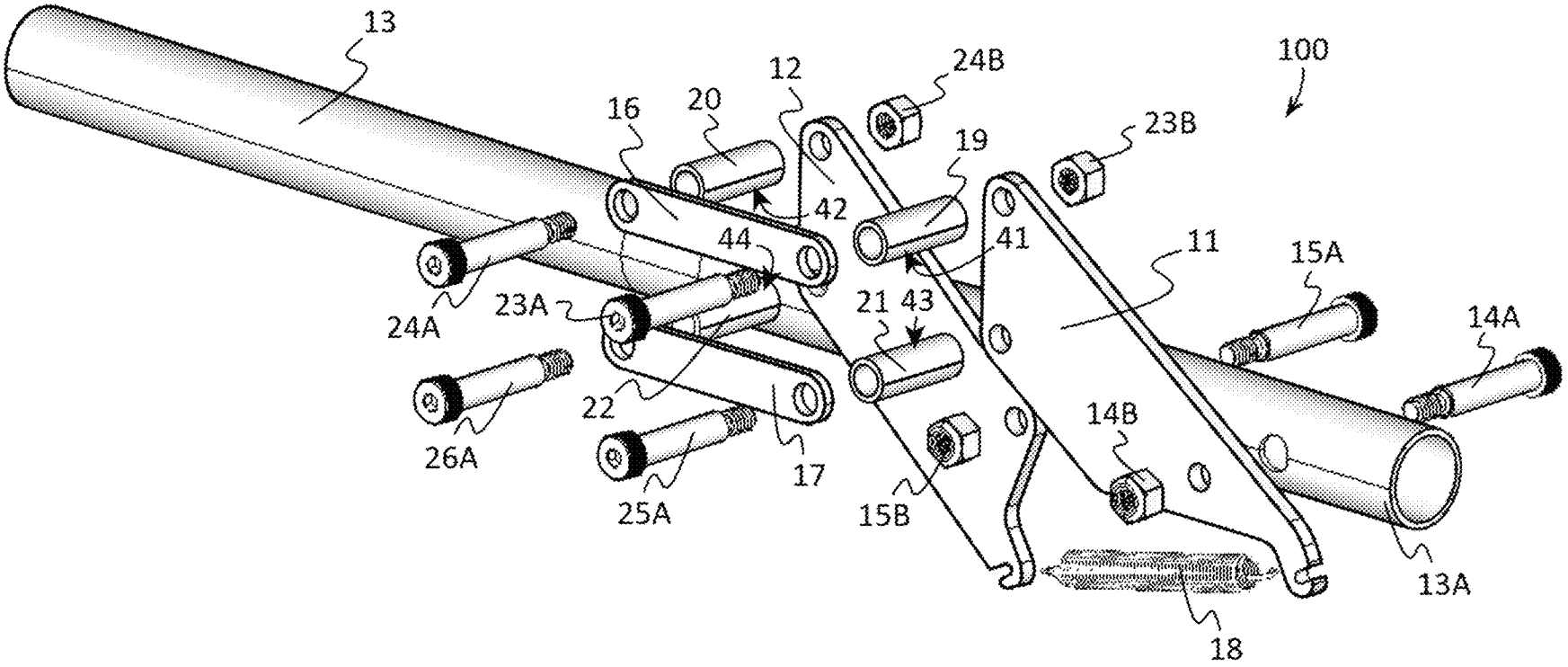
FIG. 6-FIG. 6 shows a perspective exploded view of another example of a retrieval device according to various embodiments described herein.
Figure 7:
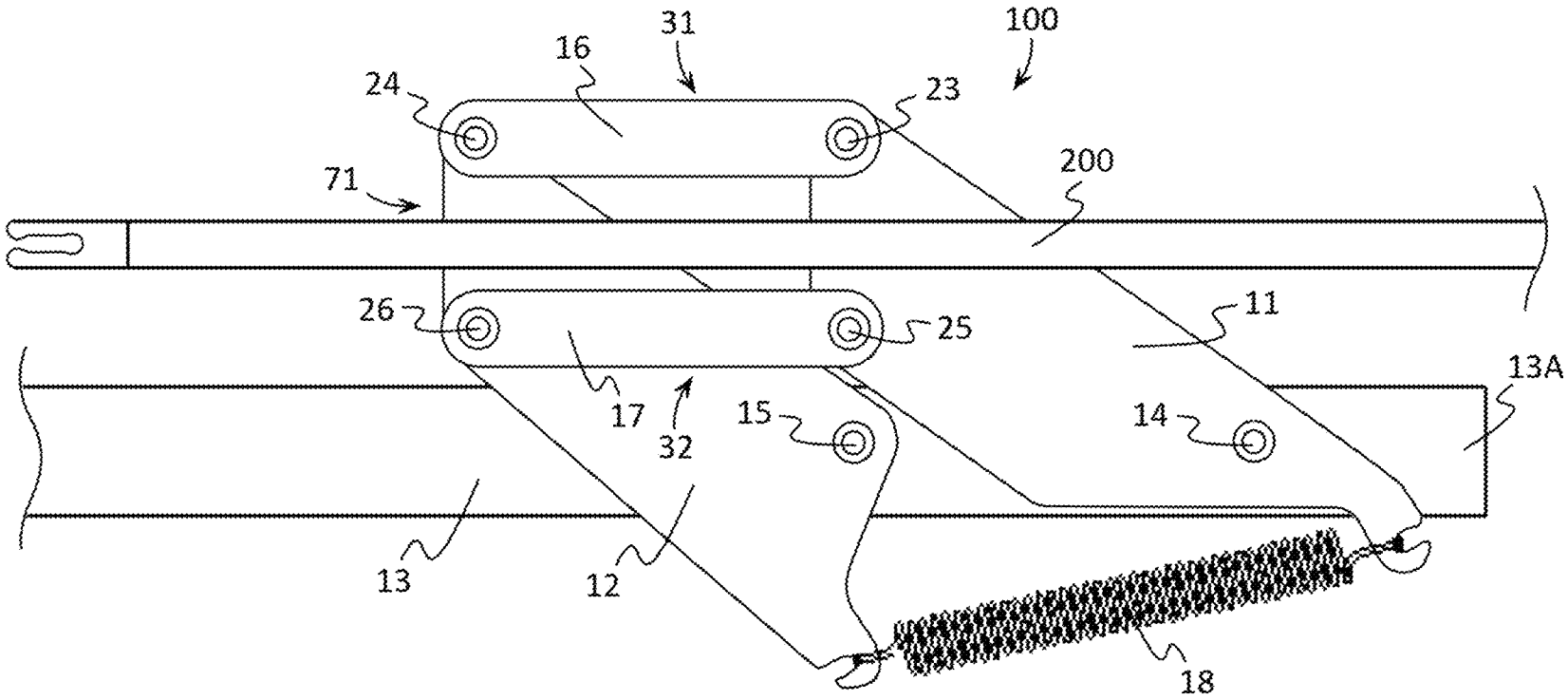
FIG. 7-FIG. 7 depicts an elevation view of another example of a retrieval device in an open position prior to engaging an object according to various embodiments described herein.
Figure 8:
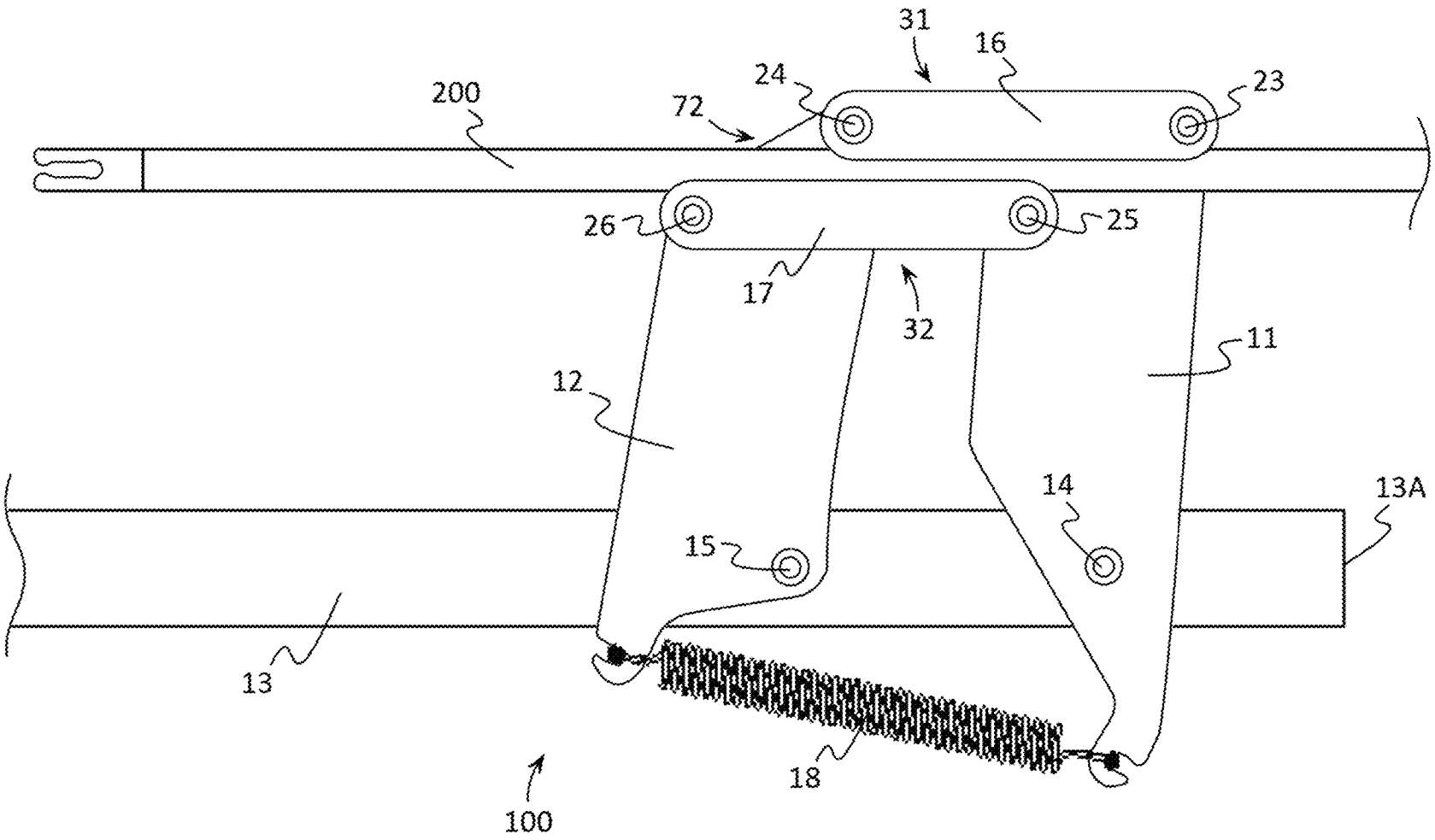
FIG. 8-FIG. 8 illustrates an elevation view of another example of a retrieval device engaging an object according to various embodiments described herein.

In preferred embodiments, the device 100 may comprise a first upper gripper 19 that may extend between or be coupled to a first 23 and a second 24 upper fastener and a first lower gripper 21 that may extend between or be coupled to a first 25 and a second 26 lower fastener, and the upper fasteners 23, 24, may remain approximately parallel to the lower fasteners 25, 26, when the device 100 is moved into and between the open position 71 and closed position 72. In this manner, the first upper gripper 19 and/or its first upper grip surface 41 may remain approximately, and more preferably substantially, parallel to the first lower gripper 21 and/or its first lower grip surface 43. For example, and shown in FIGS. 1 and 3, the first upper grip surface 41 may comprise a first plane 81 (formed by the portions of the upper grip surface 41 that may contact an object 200, such as protrusions 45) and the first lower grip surface 41 may comprise a second plane 82 (formed by the portions of the lower grip surface 43 that may contact an object 200, such as protrusions 45), and the first plane 81 may remain approximately, and more preferably substantially, parallel to the second plane 82 when the device 100 is moved into the closed position 72 (as shown in FIG. 3 in which the planes are substantially parallel). Optionally, the first plane 81 may remain approximately, and more preferably substantially, parallel to the second plane 82 when the device 100 is moved into the open position 71 (as shown in FIG. 1 in which the planes are substantially parallel as drawn to match the perspective of the device 100).

In further preferred embodiments, the device 100 may comprise a first upper gripper 19 coupled to a first upper fastener 23, a second upper gripper 20 coupled to a second upper fastener 24, a first lower gripper 21 coupled to a first lower fastener 25, and a second lower gripper 22 coupled to a second lower fastener 26, and the upper fasteners 23, 24, may remain approximately parallel to the lower fasteners 25, 26, when the device 100 is moved into and between the open position 71 and closed position. In this manner, the upper grippers 19, 20 and/or their upper grip surfaces 41, 42, may remain approximately parallel to the lower grippers 21, 22, and/or their lower grip surfaces 43, 44. For example, the distance between the first upper fastener 23 and the first lower fastener 25 may be approximately, and more preferably substantially, equal to the distance between the second upper fastener 24 and the second lower fastener 26 when the device 100 is in the open position 71 (shown by D1 and D2, respectively, in FIG. 4), and the distance between the first upper fastener 23 and the first lower fastener 25 may be approximately, and more preferably substantially, equal to the distance between the second 24 upper fastener and the second lower fastener 26 when the device 100 is in the closed position 72 (shown by D3 and D4, respectively, in FIG. 5).

In some embodiments, the device 100 may comprise a tensioner 18 which may be configured to tension the device 100 into the open position 71 or the closed position 72. In preferred embodiments, a tensioner 18 may be configured to tension the device 100 into the open position 71. A tensioner 18 may be positioned anywhere on the device 100. In preferred embodiments, the first body fastener 14 may be coupled to the first plate 11 between the upper plate connector 16 and the tensioner 18, and the second body fastener 15 may be coupled to the second plate 12 between the upper plate connector 16 and the tensioner 18. In this manner, the portion of the first plate 11 that the tensioner 18 may be coupled to may be separated from the portion of the first plate 11 that the assemblies 31, 32, are coupled to by the portion of the first plate 11 that the first body fastener 14 is coupled to. Likewise, in this manner, the portion of the second plate 12 that the tensioner 18 may be coupled to may be separated from the portion of the second plate 12 that the assemblies 31, 32, are coupled to by the portion of the second plate 12 that the second body fastener 15 is coupled to.

In further preferred embodiments, a tensioner 18 may be coupled to the first plate 11 and the second plate 12, optionally at the ends of the plates 11, 12, that are distal to the upper and lower fasteners 23, 24, 25, 26, and the tensioner 18 may be configured to tension together the portions of the plates 11, 12, that the tensioner 18 is coupled. In other embodiments, a tensioner 18 may be coupled to a plate 11, 12, and to the body 13 and configured to tension portions of the plate 11, 12, towards the body 13. In still other embodiments, a tensioner 18 may be coupled to a connector 16, 17, gripper 19, 20, 21, 22, and/or a plate connector 16 and configured to tension portions of the respective element(s) towards the body 13 so that the tensioner(s) 18 tension the device 100 into the open position 71.

In embodiments in which a tensioner 18 is coupled to the first plate 11 and the second plate 12, any suitable coupling method may be used to couple the tensioner 18 to the plates 11, 12. For example, and as perhaps best shown in FIG. 1, each plate 11, 12, may comprise a notch, cutout, recess, or other depression 27 into which portions of the tensioner 18 may be received. As another example, a fastener, such as a rivet, screw, etc., may be used to couple a portion of a tensioner 18 to a plate 11, 12, or to another element of the device 100.

In some embodiments, a tensioner 18 may comprise a spring, such as a coil spring (preferably made of stainless steel), which is an elastic object used to store mechanical energy and which may be made from out of spring steel, annealed steel which is hardened after fabrication, and non-ferrous metals including phosphor bronze, titanium, beryllium copper, or any other suitable material. In further embodiments, A tensioner 18 may comprise any type of spring such as a Tension/extension spring, Compression spring, Constant-force spring, Torsion spring, Variable spring, Coil spring, Flat spring, Machined spring, Serpentine spring, Cantilever spring, Hairspring or balance spring, Leaf spring, V-spring, Belleville washer or Belleville spring, Gas spring or gas piston, Mainspring, Negator spring, Progressive rate coil springs, Spring washer, Torsion spring, Wave spring, Rubber band, bungee cord, or other non-metallic elastic material, or any other material or device which is suitable for tensioning two elements together.

The device 100 may comprise one or more grippers, such as a first gripper 19, a second gripper 20, a third gripper 21, a fourth gripper 22, etc., which may be configured to contact portions of an object 200 which a user may desire to retrieve with the device 100. Generally, the device 100 may be movable between an open position 71, in which a first upper gripper 19 and a first lower gripper 21 are positioned relatively distally or farther apart from each other, and a closed position 72, in which the first upper gripper 19 and first lower gripper 21 are positioned relatively proximate or closer to each other or optionally in contact with each other. In preferred embodiments, the device 100 may be moved between the positions 71, 72, by pivoting the plates 11, 12, either towards or away from the working end 13A around their respective body fasteners 14, 15. In some embodiments, the device 100 may be moved between the positions 71, 72, by pivoting the plates 11, 12, towards the working end 13A, while in other embodiments, the device 100 may be moved between the positions 71, 72, by pivoting the plates 11, 12, away from the working end 13A.

Figure 2:
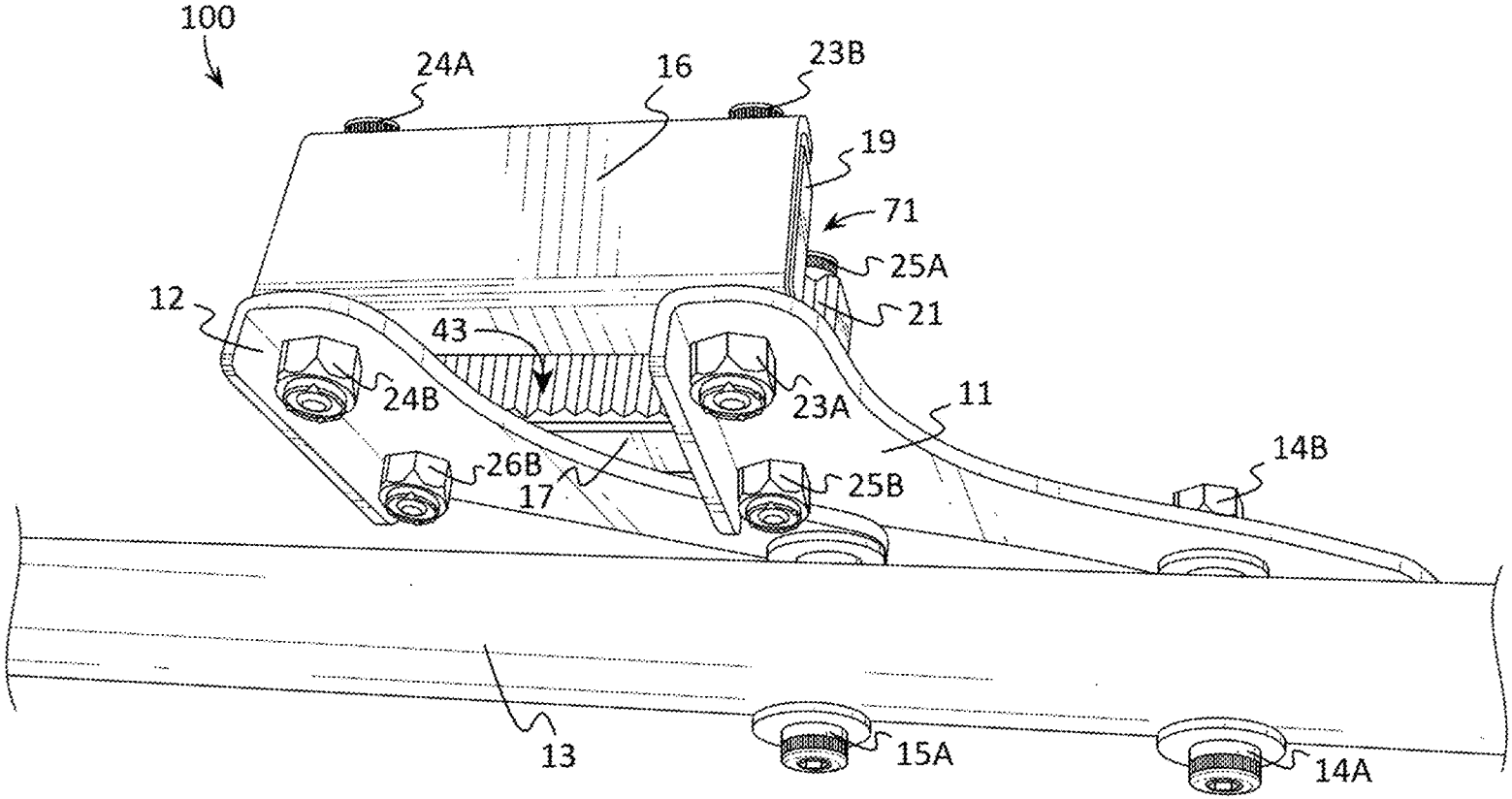
FIG. 2-FIG. 2 illustrates a rear perspective view of an example of a retrieval device in an open position according to various embodiments described herein.

A gripper 19, 20, 21, 22, may be coupled to any element of the device 100. In some embodiments, a gripper 19, 20, 21, 22, may be coupled to a plate connector 16, 17, via a fastener 23, 24, 25, 26, such as by inserting portions of the fastener 23, 24, 25, 26, through the gripper 19, 20, 21, 22. For example, and as shown in FIGS. 1-3, an upper gripper 19 may be coupled to an upper plate connector 16 via a first 23 and a second 24 upper fastener, and a lower gripper 21 may be coupled to a lower plate connector 17 via a first 25 and a second 26 lower fastener. In other embodiments, a first upper gripper 19 may be coupled to an upper fastener 23, 24, and/or an upper plate connector 16, while a first 21 and a second 22 lower gripper may be coupled to the lower fasteners 25, 26, and/or a lower plate connector 17, respectively. In this manner, the first upper gripper 19 may be moved towards and away from the first 21 and a second 22 lower grippers when the plates 11, 12, are pivoted resulting in the device 100 being moved between the closed 72 and open 71 positions, respectively. In still other embodiments, a first upper 19 and a second upper 21 gripper may be coupled to an upper fastener 23, 24, and/or an upper plate connector 16, while a first lower gripper 21 may be coupled to the lower fasteners 25, 26, and/or a lower plate connector 17, respectively. In this manner, the first upper 19 and second 20 upper grippers may be moved towards and away from the first lower gripper 21 when the plates 11, 12, are pivoted resulting in the device 100 being moved between the closed 72 and open 71 positions, respectively.

In alternative embodiments, a gripper, such as a first gripper 19, may be coupled to a plate 11, 12, plate connector 16, 17, and/or one or more fasteners 23, 24, 25, 26, while a second gripper 20 may be coupled to a portion of the body 13. In this manner, as the plates 11, 12, are pivoted around their respective body fasteners 14, 15, the first gripper 19 may be moved towards and away from the second gripper 20 on the body 13 as the device 100 is moved between the closed 72 and open 71 positions, respectively.

As another example, and as shown in FIGS. 4-8, a first upper gripper 19 may be coupled to an upper plate connector 16 via a first 23 upper fastener, a second upper gripper 20 may be coupled to the upper plate connector 16 via a second 24 upper fastener, a first lower gripper 21 may be coupled to a lower plate connector 17 via a first lower fastener 25, and second lower gripper 22 may be coupled to the lower plate connector 17 via a second 26 lower fastener. In this manner, the first 19 and second 20 upper grippers may be positioned relatively distally or farther apart from the first 21 and second 22 lower grippers when the device 100 is in the open position 71, and the first 19 and second 20 upper grippers may be positioned relatively proximate or closer to the first 21 and second 22 lower grippers when the device 100 is in the closed position 72.

In further embodiments, a gripper 19, 20, 21, 22, may be coupled to a plate connector 16, 17, plate 11, 12, and/or other element of the device 100 via heat bonding or welding, adhesive, by being integrally formed or molded together, or any other suitable coupling method.

Each gripper 19, 20, 21, 22, may comprise or form a surface 41, 42, 43, 44, for contacting and gripping an object 200 when the device 100 is moved into or towards the closed position 72. For example, a first upper gripper 19 may comprise a first upper grip surface 41, a second upper gripper 20 may comprise a second upper grip surface 42, a first lower gripper 21 may comprise a first lower grip surface 43, a second lower gripper 22 may comprise a second lower grip surface 44, etc.

Grippers 19, 20, 21, 22, and their grip surfaces 41, 42, 43, 44, may be configured in any size and shape. In some embodiments, and as shown in FIGS. 1-3, the device 100 may comprise an elongated upper gripper 19 and an elongated lower gripper 21 which may extend between the upper fasteners 23, 24, and lower fasteners 25, 26, respectively. The elongated upper gripper 19 may comprise a generally planar upper grip surface 41 and, likewise the elongated lower gripper 21 may comprise a generally planar lower grip surface 43. Optionally, a grip surface 41, 42, 43, 44, may comprise texturing in the form of one or more protrusions 45 and/or depressions 46. For example, and as shown in FIGS. 1-3, a grip surface 41, 42, 43, 44, may comprise a plurality of alternating protrusions 45 and depressions 46 (optionally in the form of elongated triangular prisms, elongated sections of a cylinder, etc.) which may allow the grip surface 41, 42, 43, 44, to be configured as a corrugated surface.

In some embodiments, and as shown in FIGS. 4-8, the device 100 may comprise one or more grippers 19, 20, 21, 22, which may be generally cylindrical in shape that may surround a fastener 23, 24, 25, 26, so that the grippers 19, 20, 21, 22, may extend from a plate connector 16, 17, to a plate 11, 12. For example, a cylindrical shaped gripper 19, 20, 21, 22, may comprise a length of 5/16-inch inner diameter rubber tubing or similar to a sleeve.

Generally, a gripper 19, 20, 21, 22, may comprise or provide a friction enhancing surface, for contacting and gripping portions of an object 200, that may be made from a resilient material. A resilient material may comprise a material which when placed into contact with another material may contribute to a relatively high friction of coefficient between the resilient material and the other material. Preferably, a resilient material may be a natural and/or synthetic material, which is flexible to allow slight deformation and resilient so as to return to its original shape after deformation. Example resilient materials include latex rubber, silicone rubber, forms of the organic compound isoprene, such as polyisoprene, Butyl rubber, Polyacrylate Rubber, Ethylene-acrylate Rubber, Polyester Urethane, Bromo Isobutylene Isoprene, Polybutadiene, Chloro Isobutylene Isoprene, Polychloroprene, Chlorosulphonated Polyethylene, Epichlorohydrin, Ethylene Propylene, Ethylene Propylene Diene Monomer, Polyether Urethane, Perfluorocarbon Rubber, Fluoronated Hydrocarbon, Fluoro Silicone, Fluorocarbon Rubber, Hydrogenated Nitrile Butadiene, Polyisoprene, Isobutylene Isoprene Butyl, Acrylonitrile Butadiene, Polyurethane, Styrene Butadiene, Styrene Ethylene Butylene Styrene Copolymer, Polysiloxane, Vinyl Methyl Silicone, Acrylonitrile Butadiene Carboxy Monomer, Styrene Butadiene Carboxy Monomer, Thermoplastic Polyether-ester, Styrene Butadiene Block Copolymer, and Styrene Butadiene Carboxy Block Copolymer. In further embodiments, a gripper 19, 20, 21, 22, may be made from and/or may comprise any material which when placed into contact with an object 200 may contribute to a friction of coefficient greater than 0.3, and more preferably greater than 0.5, between the material of the gripper 19, 20, 21, 22, and the object 200.

In some embodiments, to operate the device 100 to retrieve an object 200, such as an arrow or bolt that may be stuck in a material such as a river bank, the user may start with the device 100 in the open position 71 (FIGS. 1, 2, 4, and 7). The user may grip the body 13 at the opposite end from the moving components, such as the plates 11, 12, and position the device 100 so that the stuck arrow shaft object 200 is between at least a first upper gripper 19 and a first lower gripper 21 which may act as points of gripping or frictional contact between the device 100 and the object 200. The shaft of the arrow object 200 may be approximately parallel with the plate connectors 16, 17, so that the first upper gripper 19 and an optional second upper gripper 20 that are coupled to the upper plate connector 16 are on one side of the shaft of the arrow object 200 and the first lower gripper 21 and an optional second lower gripper 22 that are coupled to the lower plate connector 17 are on the other side of the shaft of the arrow object 200. The user may then move the device 100 so that the arrow shaft pushes against the grippers 19, 20, 21, 22, which may cause the first plate 11 and second plate 12 to swivel or pivot simultaneously into or towards the closed position 72 (FIGS. 3, 5, and 8), which causes the grippers 19, 20, 21, 22, to close around the arrow shaft. The user may then pull the body 13 towards himself, making the device 100 grip the arrow object 200, and pulls the arrow object 200 free from the riverbank it was embedded in. The pivotal coupling of the components translates the pulling motion of the user on the body 13 into closing or clamping motion of the grippers 19, 20, 21, 22, via rotation or pivoting of the plates 11, 12, in a way that increases the gripping force against the arrow object 200 as the pulling force on the body 13 is increased.

While some exemplary shapes and sizes have been provided for elements of the device 100, it should be understood to one of ordinary skill in the art that the plates 11, 12, body 13, plate connectors 16, 17, grippers 19, 20, 21, 22, fasteners 14, 15, 23, 24, 25, 26, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A retrieval device, the device comprising:

a first plate movably coupled to a body via a first body fastener;

a second plate movably coupled to the body via a second body fastener;

an upper plate connector movably coupled to the first plate and to the second plate;

a lower plate connector movably coupled to the first plate and to the second plate, wherein the lower plate connector is coupled to the first plate between the upper plate connector and the first body fastener, and wherein the lower plate connector is coupled to the second plate between the upper plate connector and the second body fastener;

a first upper gripper coupled to the upper plate connector;

a first lower gripper coupled to the lower plate connector, wherein the device is movable between an open position, in which the first upper gripper and first lower gripper are positioned relatively distally from each other, and a closed position, in which the first upper gripper and first lower gripper are positioned relatively proximate to each other; and a tensioner that is configured to tension the device in the open position, wherein the first body fastener is coupled to the first plate between the upper plate connector and the tensioner, and wherein the second body fastener is coupled to the second plate between the upper plate connector and the tensioner.

2. The device of claim 1, wherein the tensioner comprises a spring.

3. The device of claim 1, wherein the upper plate connector is movably coupled to the first plate with a first upper fastener, wherein the upper plate connector is movably coupled to the second plate with a second upper fastener, wherein the lower plate connector is movably coupled to the first plate with a first lower fastener, and wherein the lower plate connector is movably coupled to the second plate with a second lower fastener.

4. The device of claim 3, wherein the distance between the first upper fastener and the first lower fastener is substantially equal to the distance between the second upper fastener and the second lower fastener when the device is in the open position, and wherein the distance between the first upper fastener and the first lower fastener is substantially equal to the distance between the second upper fastener and the second lower fastener when the device is in the closed position.

5. The device of claim 3, wherein the first upper fastener couples the first upper gripper to the upper plate connector, and wherein the first lower fastener couples the first lower gripper to the lower plate connector.

6. The device of claim 5, wherein the second upper fastener couples the first upper gripper to the upper plate connector, and wherein the second lower fastener couples the first lower gripper to the lower plate connector.

7. The device of claim 1, wherein the first upper gripper and first lower gripper comprise a resilient material.

8. The device of claim 1, wherein the first upper gripper comprises a first plane, wherein the first lower gripper comprises a second plane, and wherein the first plane remains substantially parallel to the second plane when the device is moved into the closed position.

9. A retrieval device, the device comprising:

a first plate movably coupled to a body via a first body fastener;

a second plate movably coupled to the body via a second body fastener;

an upper plate connector movably coupled to the first plate and to the second plate, wherein upper plate connector is movably coupled to the first plate with a first upper fastener, and wherein the upper plate connector is movably coupled to the second plate with a second upper fastener;

a lower plate connector movably coupled to the first plate and to the second plate, wherein the lower plate connector is movably coupled to the first plate with a first lower fastener, wherein the lower plate connector is movably coupled to the second plate with a second lower fastener, wherein the lower plate connector is coupled to the first plate between the upper plate connector and the first body fastener, and wherein the lower plate connector is coupled to the second plate between the upper plate connector and the second body fastener;

a first upper gripper coupled to the upper plate connector, wherein the first upper fastener couples the first upper gripper to the upper plate connector;

a first lower gripper coupled to the lower plate connector, wherein the first lower fastener couples the first lower gripper to the lower plate connector, wherein the device is movable between an open position, in which the first upper gripper and first lower gripper are positioned relatively distally from each other, and a closed position, in which the first upper gripper and first lower gripper are positioned relatively proximate to each other; and a tensioner that is configured to tension the device in the open position, wherein the tensioner is coupled to the first plate and to the second plate.

10. The device of claim 9, wherein the tensioner comprises a spring.

11. The device of claim 10, wherein the first body fastener is coupled to the first plate between the upper plate connector and the tensioner, and wherein the second body fastener is coupled to the second plate between the upper plate connector and the tensioner.

12. The device of claim 9, wherein the distance between the first upper fastener and the first lower fastener is substantially equal to the distance between the second upper fastener and the second lower fastener when the device is in the open position, and wherein the distance between the first upper fastener and the first lower fastener is substantially equal to the distance between the second upper fastener and the second lower fastener when the device is in the closed position.

13. The device of claim 9, wherein the second upper fastener couples the first upper gripper to the upper plate connector, and wherein the second lower fastener couples the first lower gripper to the lower plate connector.

14. The device of claim 9, wherein the first upper gripper and first lower gripper comprise a resilient material.

15. The device of claim 9, wherein the first upper gripper comprises a first plane, wherein the first lower gripper comprises a second plane, and wherein the first plane remains substantially parallel to the second plane when the device is moved into the closed position.

* * * * *